US007029297B1

(12) United States Patent
Co et al.

(10) Patent No.: US 7,029,297 B1
(45) Date of Patent: Apr. 18, 2006

(54) PC-MOTHERBOARD TEST SOCKET WITH LEVERED HANDLES ENGAGING AND PUSHING MEMORY MODULES INTO EXTENDER-CARD SOCKET AND ACTUATING EJECTORS FOR REMOVAL

(75) Inventors: Ramon S. Co, Trabuco Canyon, CA (US); Chin-Piao Kuo, Hsinchu (TW)

(73) Assignee: Kingston Technology Corp., Fountain Valley, CA (US)

( * ) Notice: Subject to any disclaimer, the term of this patent is extended or adjusted under 35 U.S.C. 154(b) by 0 days.

(21) Appl. No.: 10/905,276

(22) Filed: Dec. 23, 2004

(51) Int. Cl.
*H01R 11/20* (2006.01)

(52) U.S. Cl. ..... 439/152; 439/160

(58) Field of Classification Search ..... 439/152, 439/160

See application file for complete search history.

(56) References Cited

U.S. PATENT DOCUMENTS

| | | | | |
|---|---|---|---|---|
| 4,946,403 | A | 8/1990 | Billman et al. | 439/326 |
| 5,106,315 | A | 4/1992 | Billman et al. | 439/160 |
| 5,379,184 | A | 1/1995 | Barraza et al. | 361/685 |
| 5,389,000 | A | 2/1995 | DiViesti et al. | 439/157 |
| 5,417,580 | A | 5/1995 | Tsai | 439/328 |
| 5,443,394 | A | 8/1995 | Billman et al. | 439/157 |
| 5,676,555 | A | 10/1997 | Yu et al. | 439/157 |
| 5,694,298 | A * | 12/1997 | Chabert et al. | 439/160 |
| 5,726,865 | A | 3/1998 | Webb et al. | 361/801 |
| 5,730,614 | A | 3/1998 | Yu | 439/326 |
| 5,889,656 | A | 3/1999 | Yin | 361/801 |
| 6,017,232 | A | 1/2000 | Tondreault et al. | 439/160 |
| 6,132,248 | A | 10/2000 | Ramey | 439/570 |
| 6,267,614 | B1 | 7/2001 | Good et al. | 439/327 |
| 6,629,855 | B1 | 10/2003 | North et al. | 439/325 |
| 6,705,882 | B1 | 3/2004 | Casses | 439/157 |
| 6,802,117 | B1 | 10/2004 | Dalisay | 29/758 |
| 2002/0182909 | A1 | 12/2002 | Stathopoulos et al. | 439/160 |
| 2003/0194892 | A1 | 10/2003 | Korber et al. | 439/160 |
| 2004/0087195 | A1 | 5/2004 | Yonenaka | 439/160 |

* cited by examiner

*Primary Examiner*—Briggitte R. Hammond
(74) *Attorney, Agent, or Firm*—Stuart T. Auvinen

(57) ABSTRACT

A memory module socket requires a reduced insertion force because a notch engager on a levered handle engages a notch on the memory module and applies downward pressure. The notch engager is forced downward as the levered handle pivots about an axis, causing the downward force to be applied to the notch on a memory module, forcing the memory module into a memory module socket on an extender card that plugs into a memory module socket on a personal computer motherboard. An ejector arm is pushed downward by the levered handle during removal. An ejector foot inside the memory module socket is pivoted upward around an ejector pivot when the ejector arm is pushed downward. The upward pivoting ejector foot pushes upward on the inserted edge of the memory module, forcing the memory module out of the memory module socket. Both ejection and insertion forces can be reduced.

22 Claims, 9 Drawing Sheets

PC-MOTHERBOARD TEST SOCKET WITH LEVERED HANDLES ENGAGING AND PUSHING MEMORY MODULES INTO EXTENDER-CARD SOCKET AND ACTUATING EJECTORS FOR REMOVAL

FIELD OF THE INVENTION

This invention relates to memory-module test sockets, and more particularly to memory-module test sockets with levered handles to aid module insertion.

BACKGROUND OF THE INVENTION

Memory modules such as dual-inline memory modules (DIMMs) are widely used in a variety of systems such as personal computers (PCs). Since profit margins for memory module manufactures are low, manufacturing costs must be reduced. Testing costs can be reduced by testing memory modules on a low-cost modified PC motherboard rather than an expensive electronic-component tester.

An extender card can be inserted into a memory module socket on a standard PC motherboard. This extender card has another memory module socket mounted on a top edge, while the bottom edge is inserted into the motherboard's memory module socket. The extender card effectively raises the location of the open memory module socket up off the surface of the motherboard, allowing easier access to the socket.

FIG. 1 shows a memory module extender card between a PC motherboard and a memory module being tested by the motherboard. Motherboard 26 has components 28 and memory module socket 18 mounted on a component side. Many components such as integrated circuit (IC) chips, resistors, capacitors, fans, connectors, and plugs can be mounted, and many motherboards have two or four memory module sockets 18.

Normally, memory module 10 is inserted directly in memory module socket 18 so that metal contacts 14 mate with metal contacts inside memory module socket 18. However, cables and components 28 may crowd around memory module socket 18, making it difficult to insert memory module 10. While module insertion is performed rarely in an end-user PC, when motherboard 26 is used to test memory modules, such restricted access is problematic.

Easier insertion of memory module 10 during such testing is provided by extender card 12. Metal contacts 24 on the bottom edge of extender card 12 are inserted into memory module socket 18. Metal traces on extender card 12 connect signals from metal contacts 24 to corresponding contacts inside extender socket 20.

During testing, memory module 10 is inserted into extender socket 20 on extender card 12. Since extender socket 20 is raised above memory module socket 18 on motherboard 26, socket access, and insertion and removal of memory module 10 are facilitated.

Some memory module sockets feature retention devices to lock the memory module into the socket. This prevents accidental loosening of the connection, or even loss of the memory module. For example, clip 22 on extender socket 20 can be moved inward to clip into notch 16 on memory module 10 after memory module 10 is fully inserted. Memory module socket 18 on motherboard 26 may also have such clips 22 for retention.

FIGS. 2A–B show operation of a retention clip on a memory module socket. Retention clip 22 is in the open position, moved outward and away from extender socket 20.

Memory module 10 is inserted into extender socket 20 with retention clip 22 open, as shown in FIG. 2A. Notch 16 is lined up with retention clip 22 when memory module 10 is fully inserted into extender socket 20.

In FIG. 2B, retention clip 22 is moved inward, causing a knob on retention clip 22 to engage inside notch 16 on memory module 10. The knob on retention clip 22 engaging notch 16 prevents accidental removal of memory module 10.

However, memory module 10 must be fully inserted into extender socket 20 before retention clip 22 can be clipped into notch 16. A fair amount of force needs to be applied to memory module 10 by the user to insert memory module 10 fully into extender socket 20.

While insertion force may be significant, the force necessary for removal may be more difficult to apply, since it is a pulling rather than a pushing force. Some memory module sockets are equipped with ejectors to initially remove or start removal of an inserted memory module.

FIGS. 3A–B show operation of an ejector in a memory module socket. An extension of retention clip 22 may be formed below the fulcrum or pivot point of retention clip 22. This extension is normally hidden from view, inside extender socket 20. The extension of retention clip 22 is extension ejector 30 in FIGS. 3A–B.

When memory module 10 is fully inserted into extender socket 20, and retention clip 22 is clipped into notch 16, as shown in FIG. 3A, extension ejector 30 is in its lowest position, below memory module 10. The bottom (connector) edge of memory module 10 may touch a foot portion on the end of extension ejector 30.

To begin removal of memory module 10, a user pulls outward retention clip 22, as shown in FIG. 3B. As retention clip 22 is moved outward, extension ejector 30 pivots upward inside extender socket 20. The foot of extension ejector 30 pushes upward against the bottom edge of memory module 10, forcing memory module 10 upward out of extender socket 20. Typically extension ejector 30 only moves memory module 10 upward a slight distance, and the user finished removal of memory module 10 by pulling upward on it.

While such retention clips and extender cards are useful, a strong force is often needed to insert the memory module. When a technician or test operator has to manually force memory modules into test sockets, such forces can produce repetitive stress injuries or may damage the memory module, extender card, or motherboard tester. Often memory modules must be replaced every 2–5 minutes in a test or lab environment.

What is desired is a memory module extender socket with an insertion aid. A memory module socket that uses leverage to increase the user's force on the memory module during insertion is desirable. A test apparatus with extender cards and leveraged insertion of memory modules into sockets is desirable.

DETAILED DESCRIPTION

The present invention relates to an improvement in memory module sockets. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventors have realized that leverage can be used to increase the user's force on a memory module during insertion. Rather than simply retaining the memory module in the socket after insertion, as retention clips do, levered handles apply downward force on a memory module before it is fully inserted. Thus insertion of memory modules into sockets is eased.

Figure 1:
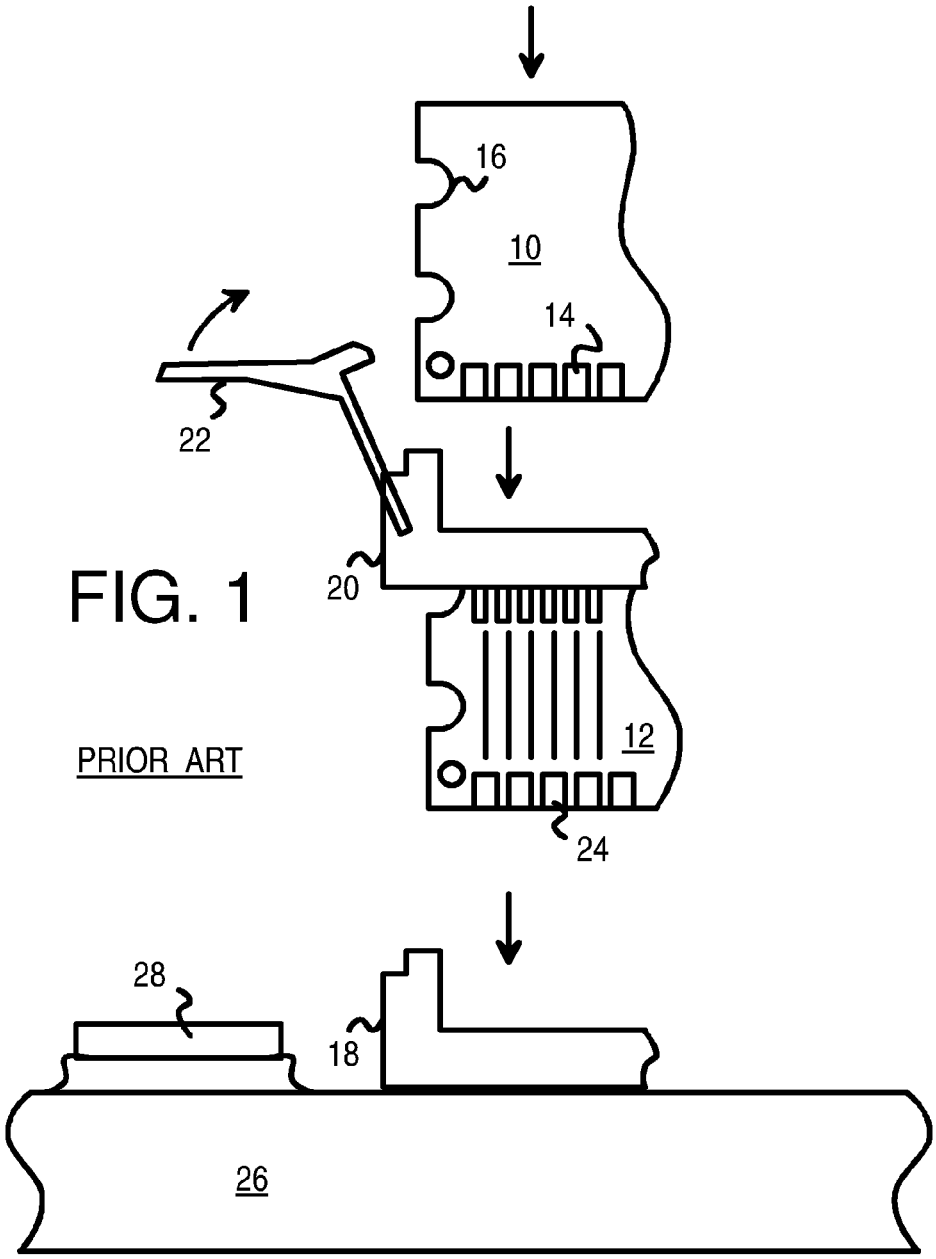
FIG. 1 PRIOR ART
FIG. 1 shows a memory module extender card between a PC motherboard and a memory module being tested by the motherboard.
Figure 2A:
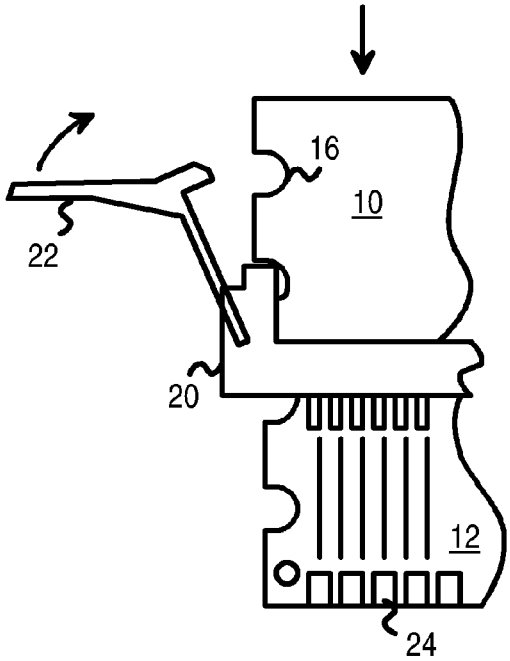
FIG. 2A PRIOR ART
FIGS. 2A–B show operation of a retention clip on a memory module socket.
Figure 2B:
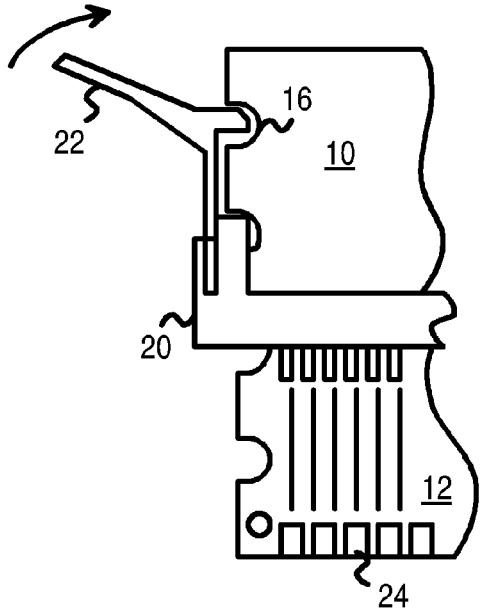
FIG. 2B PRIOR ART
Figure 3A:
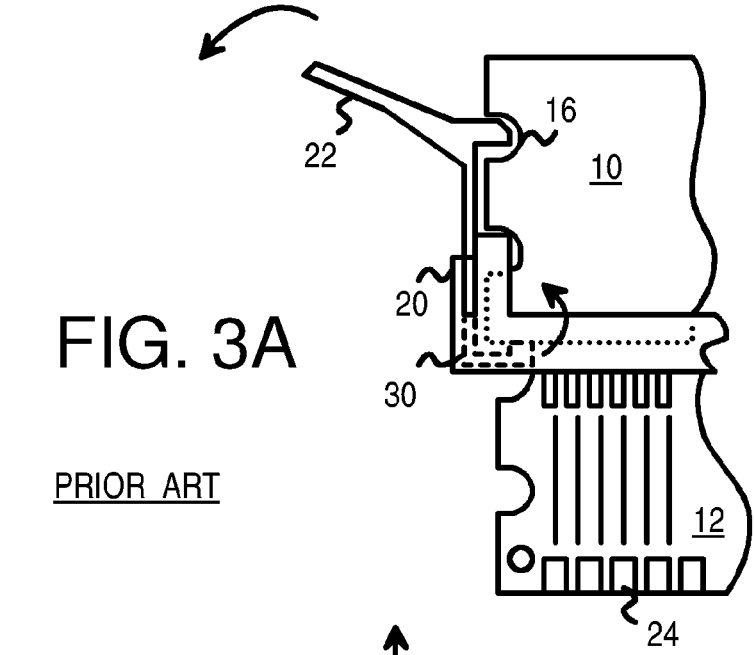
FIG. 3A PRIOR ART
FIGS. 3A–B show operation of an ejector in a memory module socket.
Figure 3B:
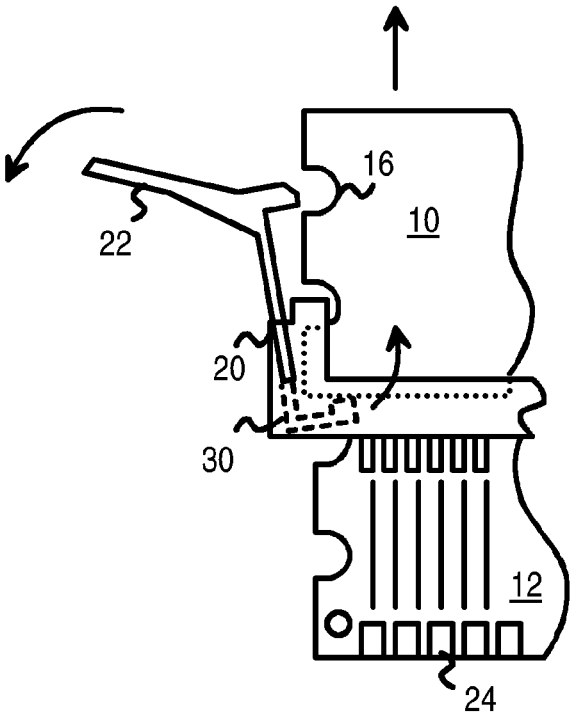
FIG. 3B PRIOR ART
Figure 4A:
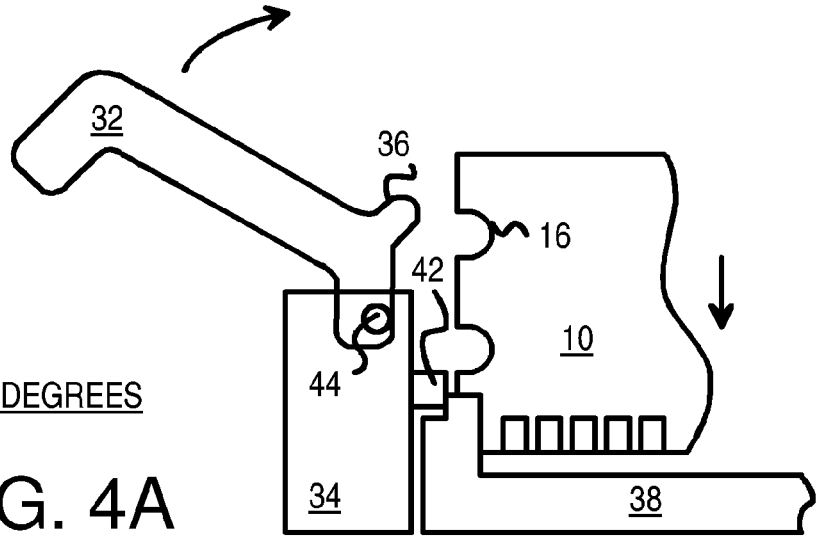
FIGS. 4A–D illustrate operation of a leveraged handle to apply an insertion force on a memory module being inserted into a memory module socket.

FIGS. 4A–D illustrate operation of a leveraged handle to apply an insertion force on a memory module being inserted into a memory module socket. In FIG. 4A, memory module 10 is partially inserted by a user into a slot opening in memory module socket 38. Guides along the sides of memory module socket 38 may guide memory module 10 into position.

Levered handle 32 is in the fully opened position. Notch engager 36 is formed on levered handle 32 and is tiled away from memory module 10 being inserted into memory module socket 38.

Figure 4B:
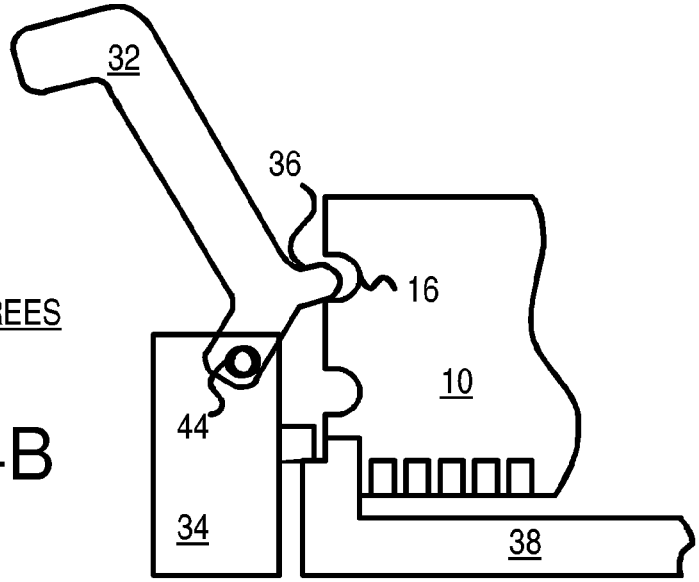

In FIG. 4B, levered handle 32 is pivoted about 30 degrees around its pivot point, axis 44 on mount 34. The far end of levered handle 32 if lifted by the user, causing notch engager 36 to be moved downward and toward memory module 10. With memory module 10 inserted a proper amount into memory module socket 38, notch 16 aligns with notch engager 36 when levered handle 32 is rotated about axis 44. If notch 16 on memory module 10 is too high relative to notch engager 36, then the user can push memory module farther down into memory module socket 38 until notch 16 aligns with notch engager 36.

Figure 4C:
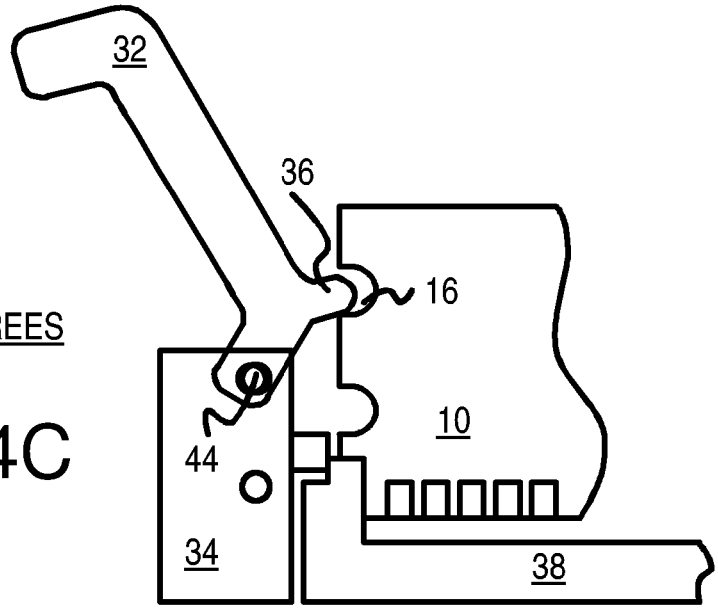

The bottom of notch engager 36 begins to push against the bottom of notch 16 as levered handle 32 is lifted further. In FIG. 4C, notch engager 36 has just started to push down against notch 16. As levered handle 32 is rotated further, from 30 degrees on to 45 degrees from the initial position of FIG. 4A, memory module 10 is forced downward, farther into memory module socket 38.

Figure 4D:
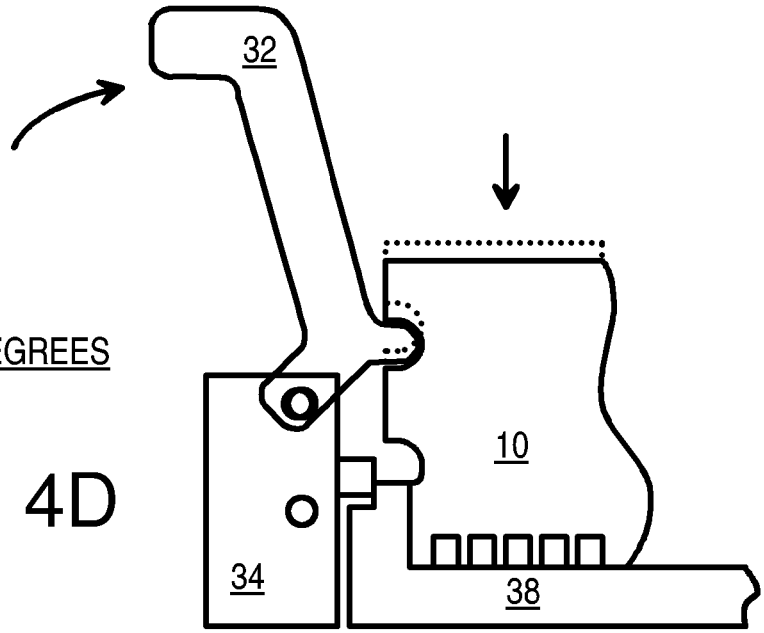

In FIG. 4D, after levered handle 32 has been rotated the full 45 degrees, memory module 10 is fully inserted into memory module socket 38. Good electrical contact is made between the metal contacts on memory module 10 and those in memory module socket 38.

While the amount of downward movement of memory module 10 as levered handle 32 is rotated from 30 to 45 degrees may appear to be small, as shown by the dotted lines of memory module 10 in FIG. 4D, this portion of module insertion often required the greatest force as the metal contacts rub together and make their tightest fit. Thus the user is spared from direct application of the greatest force by use of levered handle 32. Due to its leveraging ability, levered handle 32 multiplies the force applied by the user, resulting in a greater force applied to memory module 10 by notch engager 36 than the user applies to the end of levered handle 32. Of course, should the user hold levered handle 32 in the middle of its arm, rather than the far end, the amount of leverage is reduced, and the user must apply greater force.

Figure 5:
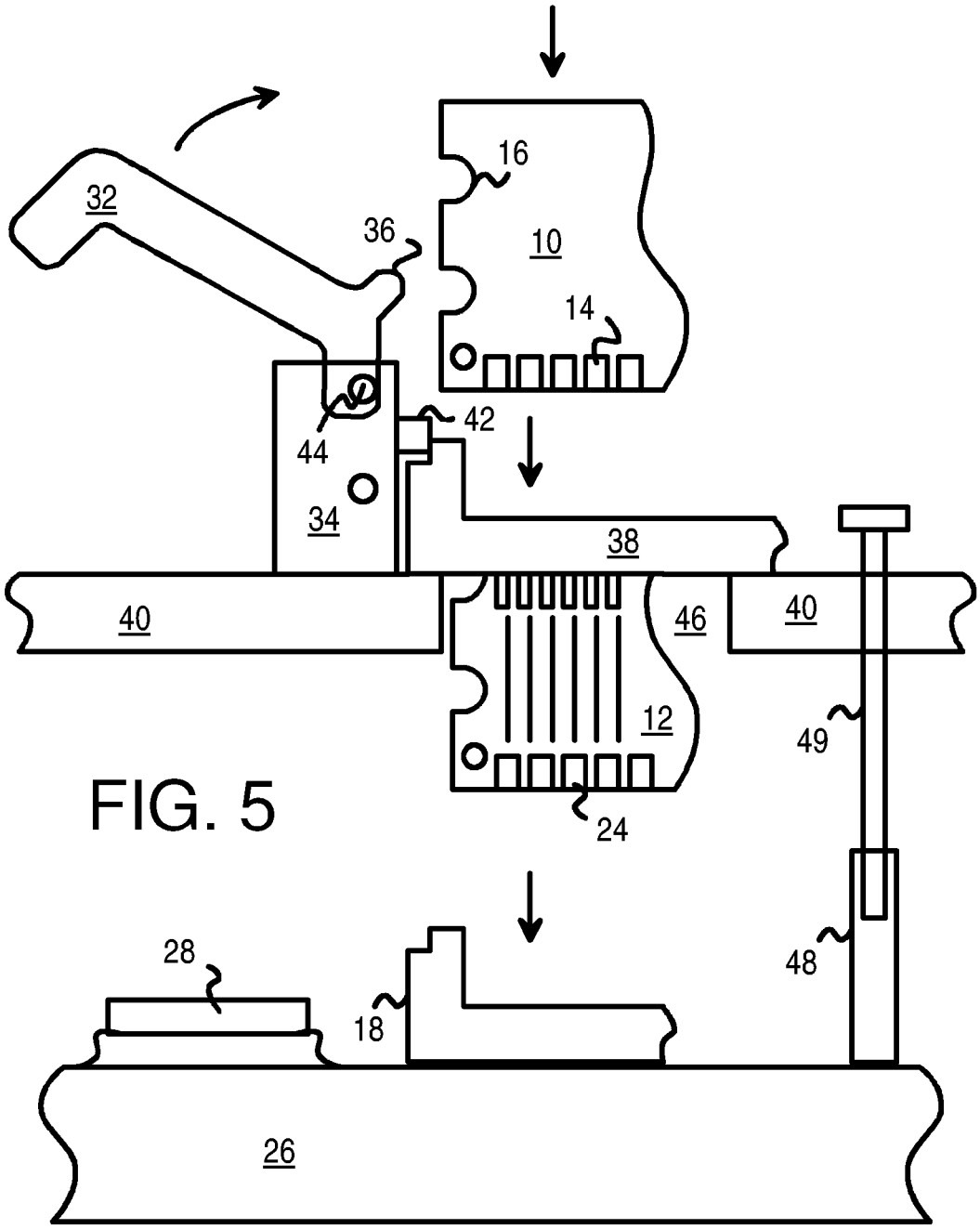
FIG. 5 shows a test adapter board with an extender card and a levered handle for aiding insertion of memory modules.

While levered handle 32, notch engager 36, and mount 34 may be part of or mounted next to a standard memory module socket, such as a socket on a PC motherboard, one embodiment uses them as part of a test adapter board. FIG. 5 shows a test adapter board with an extender card and a levered handle for aiding insertion of memory modules.

Levered handle 32, shown in its open position, is lifted upward by a user to rotate about axis 44 on mount 34, causing notch engager 36 to engage notch 16 in memory module 10 when memory module 10 is inserted a proper, partial amount into memory module socket 38. The force exerted by notch engager 36 onto notch 16 forces memory module 10 downward so that metal contacts 14 mate with contacts inside memory module socket 38.

Only the left end of memory module socket 38 is shown. Another levered handle 32 mounted to another mount 34 are on the right end of memory module socket 38 and apply force on that right end of memory module 10 in a similar fashion. These right-side elements are not shown, but can be seen in FIG. 7.

Mount 34 is itself mounted to base board 40, which can be attached above motherboard 26 by several standoffs 48. Screw or bolt 49 can fit through a hole in base board 40, through a hollow center of standoff 48, and through another hole in motherboard 26. Other kinds of board attachments can be substituted for standoffs 48.

Standoffs 48 and the height of extender card 12 can be made tall enough to allow for sufficient clearance or space between base board 40 and motherboard 26 so that components 28 have enough air flow for cooling.

Memory module socket 38 is part of extender card 12, being attached to an upper edge of extender card 12. The lower edge of extender card 12 has metal contacts 24, which fit inside memory module socket 18 on motherboard 26. Extender card 12 fits in opening 46 in base board 40. Opening 46 is wider than extender card 12, but not as wide as memory module socket 38, allowing the ends of memory module socket 38 to rest on the upper surface of base board 40 around opening 46.

Bar 42 on mount 34 can fit in a notch on the ends of memory module socket 38 as shown, to hold memory module socket 38 down on the top surface of base board 40. Memory module socket 38 and extender card 12 can be held firmly in place to base board 40, which can then be lowered into position over motherboard 26, as metal contacts 24 of extender card 12 are fitted into memory module socket 18.

Figure 6A:
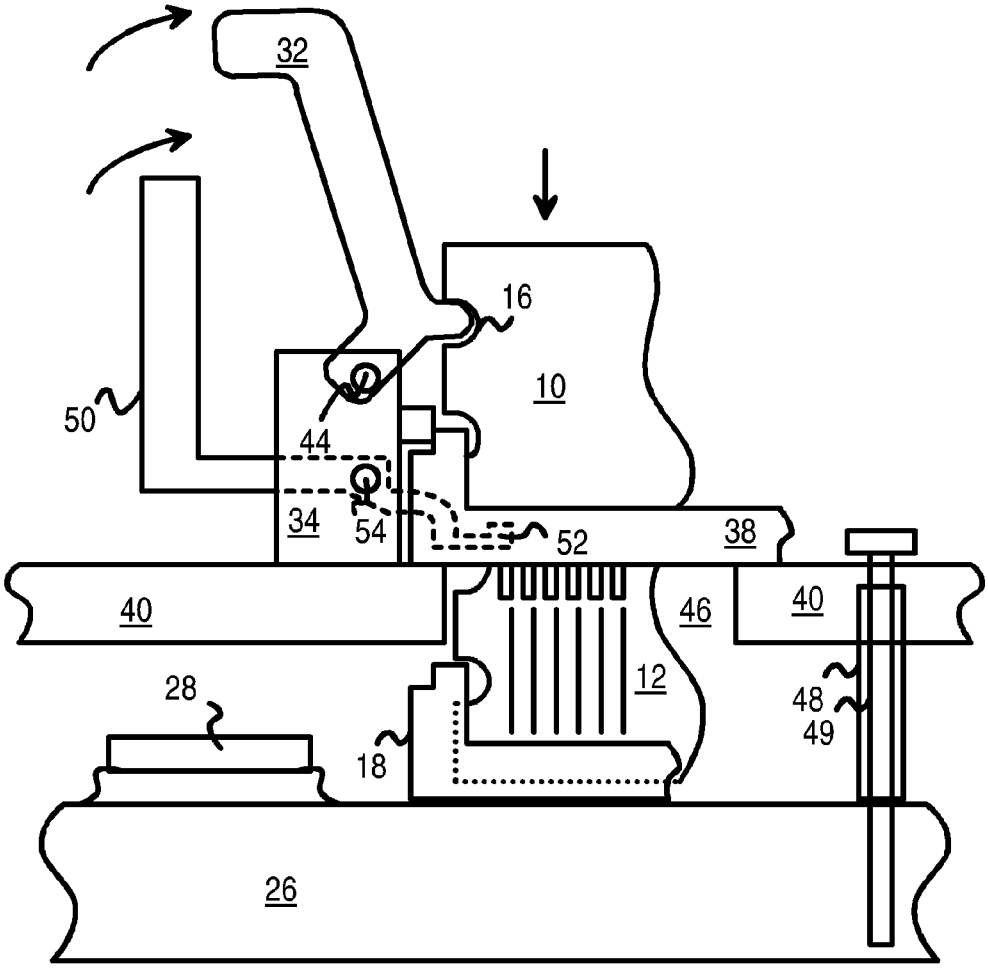
FIGS. 6A–B show operation of an ejector activated by the levered handle on a test adapter board.
Figure 6B:
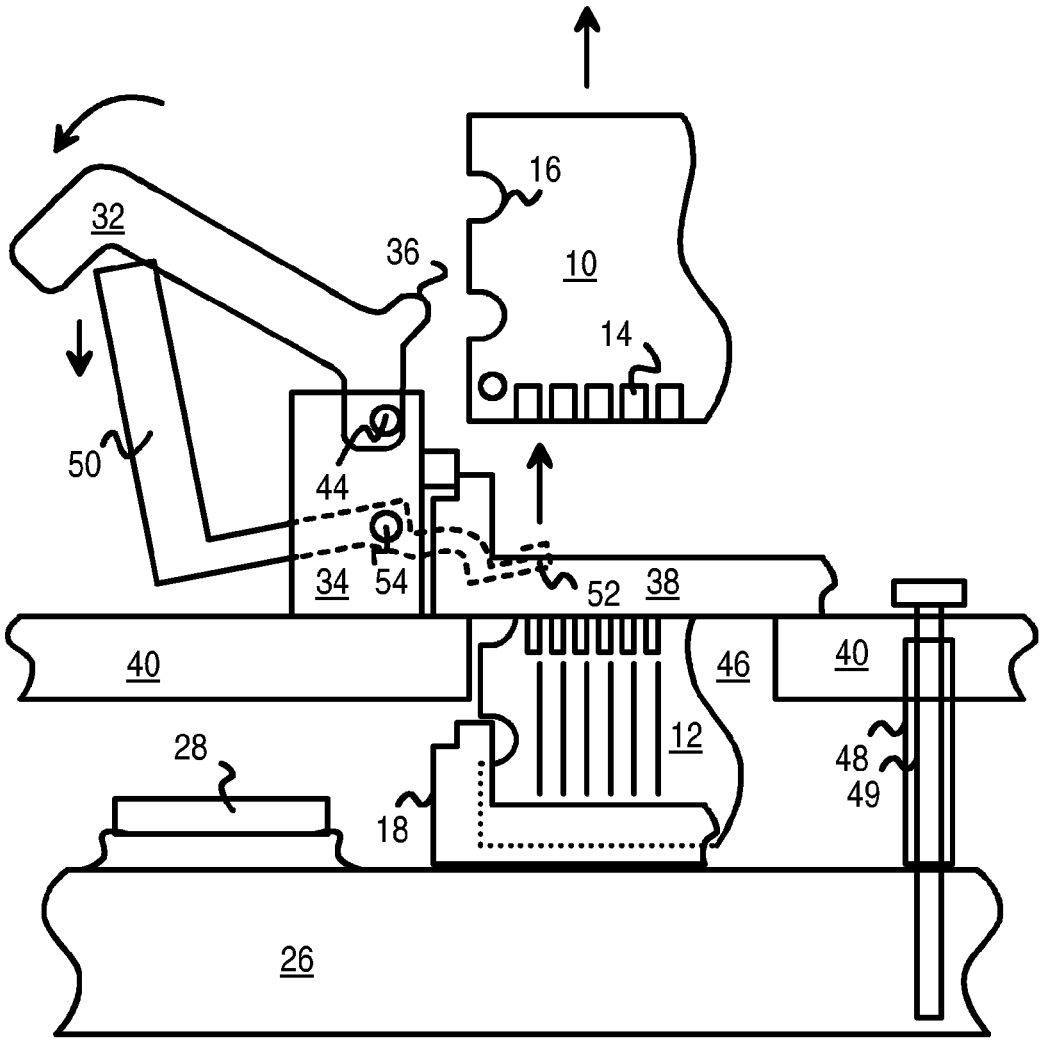

FIGS. 6A–B show operation of an ejector activated by the levered handle on a test adapter board. Base board 40 is shown mounted to motherboard 26 by standoffs 48 and bolt 49. Three, four, or more of such standoffs 48 may be used, preferably using existing holes on motherboard 26. Levered handle 32 operates as described before, with notch engager 36 engaging and pushing on notch 16 to apply downward force on memory module 10, forcing it into memory module socket 38. In FIG. 6A memory module 10 is fully inserted.

Ejector foot 52 is pushed downward by the bottom edge of memory module 10 when fully inserted, causing ejector arm 50 to be in the upright position shown in FIG. 6A. Ejector foot 52 and ejector arm 50 are on opposite sides of ejector pivot 54, which can be an axis such as a bolt, as can axis 44 of levered handle 32.

During ejection, the user pushed down on the end of levered handle 32, causing it to rotate about axis 44. Notch engager 36 is pulled out from notch 16. As levered handle 32 is pushed downward, it contacts the top of ejector arm 50. Ejector arm 50 is pushed downward and outward, rotating around ejector pivot 54. Since ejector foot 52 is fixed to ejector arm 50 through ejector pivot 54, ejector foot 52 rotates upward around ejector pivot 54, applying an upward force on the bottom edge of memory module 10. Memory module is forced out of memory module socket 38 by a slight amount. Since the greatest ejection force is often the initial movement of memory module 10, this initial ejection reduces the force required of the user to pull memory module 10 completely out of memory module socket 38.

The combination of levered handle 32, which applies an insertion force through notch engager 36, and ejector arm 50, which provides an ejection force through ejector pivot 54, reduces the forces the user applies to memory module 10. This can reduce the possibility of injuries to the user, such as repetitive-stress injuries.

Figure 7:
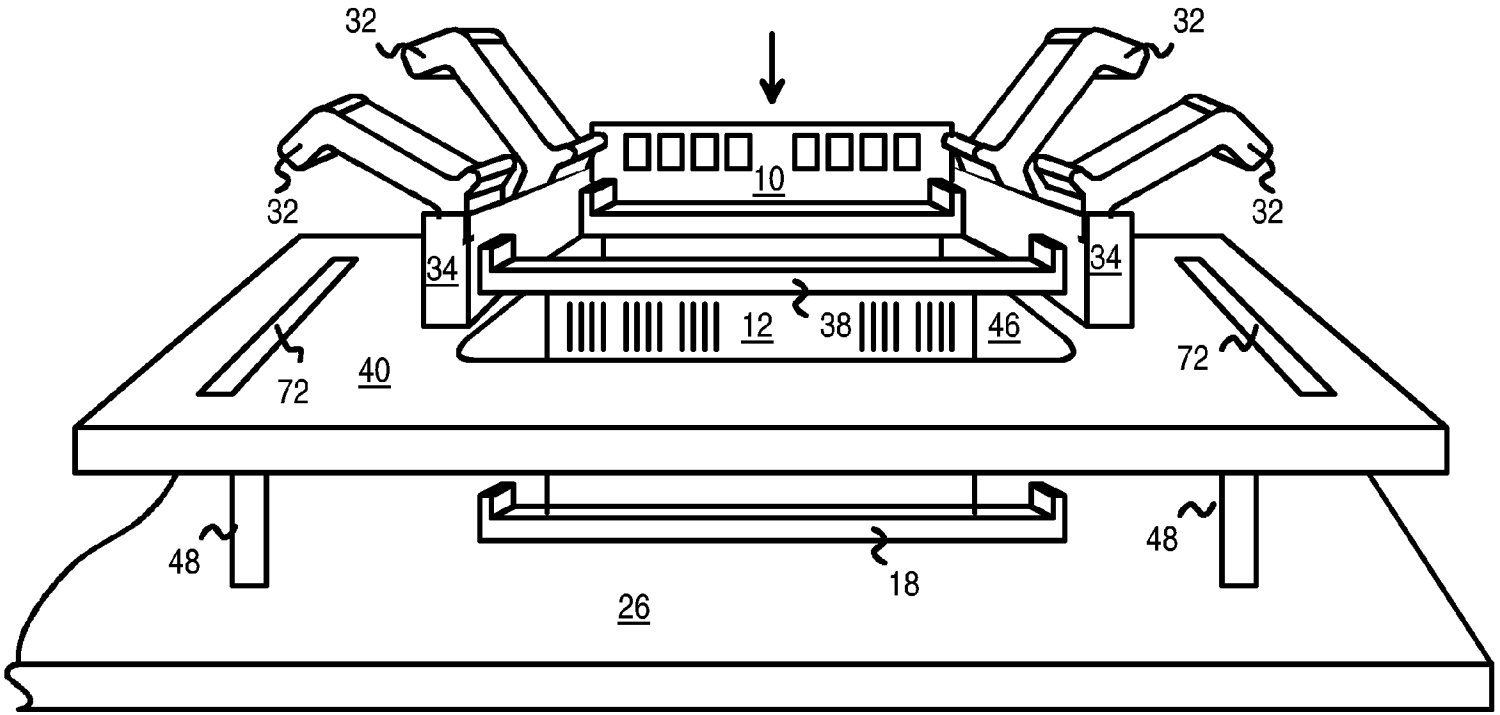
FIG. 7 is a perspective view of a motherboard tester with the test adaptor board with levered handles to ease insertion of memory modules.

FIG. 7 is a perspective view of a motherboard tester with the test adaptor board with levered handles to ease insertion of memory modules. Test programs that test memory can be executed on motherboard 26, such as memory tests during boot-up or more extensive tests run after initialization. A memory module is normally inserted into memory module socket 18 in a standard PC, but instead extender card 12 is inserted into memory module socket 18. The top of extender card 12 has memory module socket 38 that receives memory module 10 for testing.

More than one memory module 10 may be tested at a time. A second extender card 12 with a second memory module socket 38 can also be supported by base board 40. Two pairs of levered handles 32 can be fitted on mounts 34, each pair engaging a notch 16 on a different memory module 10 being inserted into a different memory module socket 38. In another embodiment, each levered handle 32 can engage two memory modules 10, with two memory module sockets 38 for each pair of levered handles 32. One opening 46 can have four extender cards 12, or two or more separate openings 46 may be used.

Ribs 72 may be formed on base board 40. Ribs 42 may fit inside a heater cover (not shown) that can be placed over memory modules 10 when inserted into memory module sockets 38. The heater cover and base board 40 form a heat chamber that allows memory modules 10 to be heated and tested at an elevated temperature. The heater cover could also be attached to base board 40 by a hinge.

ALTERNATE EMBODIMENTS

Several other embodiments are contemplated by the inventors. For example base board 40 may have a variety of shapes and have various cutouts and openings 46 to fit extender cards 12 and components on motherboard 26 that protrude above base board 40. Base board 40 may be made from a thicker, more insulating material or fiberglass to improve the heat chamber. While engagement of notch engager 36 with an upper notch 16 of memory module 10 has been shown, engagement with a lower notch or other feature of a memory module could occur with an appropriate position and design of levered handle 32, axis 44, and notch engager 36. Rotations of different amounts other than 30 or 45 degrees can be designed for by changes to levered handle 32, mount 34, notch engager 36, and their positions relative to notch 16 and memory module socket 38. The length or levered moment arm of levered handle 32 may be increased or decreased, changing the leverage efficiency.

More than one memory module socket may be used on base board 40. Each levered handle 32 could engage just one notch on one memory module, or notch engager 36 could have an elongated depth (the direction normal to the plane of FIG. 5) so that notched on two or more memory modules could be engaged simultaneously.

Various other enhancements can be made, such as locks, stops, or holding mechanisms for holding levered handle 32 in its various positions. The levered handles could be attached to a base that is attached directly to a memory module socket, without using a base board 40.

Positions such as up, down, etc. are relative and may be interchangeable, such as when the socket is transformed or re-positioned. The levered handle can be made from a variety of materials such as metal or rigid plastic. The notch engager can be integral with the levered handle or attached to the levered handle.

Rather than use bar 42 (see FIG. 5), a screw (not shown) horizontally through mount 34 can attach to the side of memory module socket 38 to hold memory module socket 38 and extender card 12 in place on base board 40. Memory module socket 38 could be mounted to base board 40 or to mount 34 in a variety of other ways, such as by adhesive, clamps, screws or bolts in various locations, etc. The shape and size of opening 46 can vary, such as one or more long rectangles or ovals to closely fit one or more extender cards 12, or other shapes.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A memory module test socket comprising:

a memory module connector socket having a slot for receiving a connector edge of a memory module, the slot having metal contacts for contacting metal contacts by the connector edge of the memory module;

the memory module connector socket having a middle portion having the slot and having end portions on opposing sides of the middle portion;

a levered handle pivoting near the end portion of the memory module connector socket;

an axis of the levered handle, the levered handle pivoting around the axis in an insertion direction;

a notch engager on the levered handle, the notch engager positioned to engage a notch on an edge of the memory module when the memory module is inserted and the levered handle is pivoted in the insertion direction around the axis; and wherein the notch engager exerts a downward force on the notch of the memory module when the levered handle is pivoted around the axis in the insertion direction, the downward force on the notch causing the memory module to be forced into the slot of the memory module connector socket, whereby the memory module is forced into the slot by the notch engager on the levered handle being pivoted in the insertion direction.

2. The memory module test socket of claim 1 wherein the levered handle pivots in a plane of the memory module when inserted into the slot, the axis being perpendicular to the plane, the memory module having a printed-circuit board (PCB) with major surfaces in the plane or parallel to the plane.

3. The memory module test socket of claim 2 wherein the notch engager pivots away from the notch and the memory module when the levered handle is pivoted around the axis in a direction opposite to the insertion direction for removal of the memory module.

4. The memory module test socket of claim 3 further comprising:

guides in the end portions of the memory module connector, the guides for receiving edges of the memory module to slide along when the memory module is being inserted.

5. The memory module test socket of claim 3 wherein the axis is formed in a mount attached to the end portion of the memory module connector socket or is formed in the end portion of the memory module connector socket.

6. The memory module test socket of claim 3 wherein the notch engager and a major arm of the levered handle are on a same side of the axis.

7. The memory module test socket of claim 3 wherein a force applied by a user to an end of the levered handle is multiplied by leverage to create the downward force that the notch engager exerts on the notch of the memory module.

8. The memory module test socket of claim 7 further comprising:

an ejector axis parallel to the axis;

an ejector arm that pivots about the ejector axis;

an ejector foot, fixed to the ejector arm so that the ejector foot pivots about the ejector axis when the ejector arm pivots;

wherein the ejector foot presses upward against the connector edge of the memory module when the memory module is inserted into the slot and the ejector arm is pivoted to eject the memory module;

wherein the ejector foot exerts an ejecting pressure against the memory module that is fully inserted and the ejector arm is pivoted in an ejecting direction.

9. The memory module test socket of claim 8 wherein the levered handle presses against the ejector arm to pivot the ejector arm in the ejecting direction when the levered handle is pivoted in the direction opposite the insertion direction.

10. The memory module test socket of claim 9 further comprising:

an extender card having the memory module connector socket mounted on a top edge, and a connector edge having metal contacts for insertion in a memory module socket on a personal computer motherboard.

11. The memory module test socket of claim 10 further comprising:

a base board having the end portions of the memory module connector socket mounted thereon, the base board having an opening under at least part of the middle portion of the memory module connector socket, the opening for the extender card to pass through to reach a memory module socket on a motherboard below the base board.

12. The memory module test socket of claim 11 further comprising:

a first mount, mounted to the base board, connected to the levered handle by the axis, the first mount mounted near a first end of the memory module connector socket, the first end being one of the end portions;

a second levered handle pivoting near a second end of the memory module connector socket, the second end being one of the end portions;

a second axis of the second levered handle, the second levered handle pivoting around the second axis in a second insertion direction;

a second notch engager on the second levered handle, the second notch engager positioned to engage a second notch on the memory module when the memory module is inserted and the second levered handle is pivoted in the second insertion direction around the second axis;

wherein the second notch engager exerts a downward force on the second notch of the memory module when the second levered handle is pivoted around the second axis in the second insertion direction, the downward force on the second notch also causing the memory module to be forced into the slot of the memory module connector socket; and a second mount, mounted to the base board, connected to the second levered handle by the second axis, the second mount mounted near the second end of the memory module connector socket, the second end being one of the end portions.

13. A test apparatus comprising:

socket means for receiving a connector edge of a memory module under test;

motherboard means for executing test programs to test the memory module under test, the motherboard means having a memory module socket;

extender card means for electrically connecting contacts inside the socket means to metal contacts on a card connector edge of the extender card means, the card connector edge for insertion into the memory module socket on the motherboard means;

base board means, mounted above the memory module socket on the motherboard means and having an opening directly above the memory module socket, for supporting the socket means above the motherboard means;

first levered handle means for pivoting about a first axis;

first mount means, mounted to the base board means by a first end of the socket means, for supporting the first levered handle means at the first axis; and first notch engage means, fixedly coupled to the first levered handle means, for engaging a first notch on the memory module under test;

wherein the first notch engage means applies an insertion force on the first notch when the first levered handle means is pivoted about the first axis in a first insertion direction, the insertion force forcing the connector edge of the memory module under test into the socket means, whereby the insertion force is produced by pivoting the first levered handle means in the first insertion direction.

14. The test apparatus of claim 13 further comprising:

second levered handle means for pivoting about a second axis;

second mount means, mounted to the base board means by a second end of the socket means, for supporting the second levered handle means at the second axis; and second notch engage means, fixedly coupled to the second levered handle means, for engaging a second notch on the memory module under test;

wherein the second notch engage means applies an insertion force on the second notch when the second levered handle means is pivoted about the second axis in a second insertion direction, the insertion force forcing the connector edge of the memory module under test into the socket means.

15. The test apparatus of claim 14 further comprising:

back socket means for receiving a connector edge of a second memory module under test;

wherein the motherboard means executes test programs to test the memory module under test and the second memory module under test, the motherboard means having a second memory module socket;

second extender card means for electrically connecting contacts inside the back socket means to metal contacts on a card connector edge of the second extender card means, the card connector edge for insertion into the second memory module socket on the motherboard means;

first back levered handle means for pivoting about a first back axis;

first back mount means, mounted to the base board means by a first end of the back socket means, for supporting the first back levered handle means at the first back axis;

first back notch engage means, fixedly coupled to the first back levered handle means, for engaging a first back notch on the second memory module under test;

wherein the first back notch engage means applies an insertion force on the first back notch when the first back levered handle means is pivoted about the first back axis in a first back insertion direction, the insertion force forcing the connector edge of the second memory module under test into the back socket means, second back levered handle means for pivoting about a second back axis;

second back mount means, mounted to the base board means by a second end of the back socket means, for supporting the second back levered handle means at the second back axis; and second back notch engage means, fixedly coupled to the second back levered handle means, for engaging a second back notch on the second memory module under test;

wherein the second back notch engage means applies an insertion force on the second back notch when the second back levered handle means is pivoted about the second back axis in a second back insertion direction, the insertion force forcing the connector edge of the second memory module under test into the back socket means, whereby two memory modules are inserted and tested.

16. The test apparatus of claim 15 further comprising:

first ejector means, activated by pivoting of the first levered handle means in a direction opposite to the first insertion direction, for applying an ejecting force onto the connector edge of the memory module under test, whereby module ejection is assisted by movement of the first levered handle means.

17. A reduced-insertion-force memory module socket comprising:

a first supporting mount having a first axis;

a second supporting mount having a second axis substantially parallel to the first axis;

a memory module socket between the first and second supporting mounts, the memory module socket having its longest dimension between the first and second supporting mounts, the memory module socket having a slot for receiving a connector edge of a memory module under test;

a first levered handle connected to the first supporting mount by the first axis and rotating about the first axis;

a first notch engager on the first levered handle, the first notch engager fitting into a first notch on a first end of the memory module under test when partially inserted into the memory module socket;

wherein the first notch engager is closer to the first axis than an end of the first levered handle;

a second levered handle connected to the second supporting mount by the second axis and rotating about the second axis; and a second notch engager on the second levered handle, the second notch engager fitting into a second notch on a second end of the memory module under test when partially inserted into the memory module socket;

wherein the second notch engager is closer to the second axis than an end of the second levered handle;

wherein the first notch engager applies a first insertion force onto the first notch when the first levered handle is rotated in an insertion movement, the first insertion force forcing the connector edge of the memory module under test firmly into the slot of the memory module socket;

wherein the second notch engager applies a second insertion force onto the second notch when the second levered handle is rotated in an insertion movement, the second insertion force forcing the connector edge of the memory module under test firmly into the slot of the memory module socket;

wherein the first and second insertion forces are generated by the insertion movements of the first and second levered handles.

18. The reduced-insertion-force memory module socket of claim 17 wherein the first axis and the second axis are both substantially perpendicular to a plane of a component surface of the memory module under test when inserted.

19. The reduced-insertion-force memory module socket of claim 18 further comprising:

a base board that has the first and second bases mounted on a surface, and has an opening for an extender card attached to the memory module socket;

wherein the extender card has a connector edge for insertion into a memory module socket on a mother-board tester.

20. The reduced-insertion-force memory module socket of claim 19 wherein the first supporting mount further comprises a hold-down bar or a screw to hold the memory module socket to the base board;

wherein the second supporting mount further comprises a hold-down bar or a screw to hold the memory module socket to the base board.

21. The reduced-insertion-force memory module socket of claim 19 wherein the first notch engager has a rounded cross-sectional shape that at least partially matches a shape of the first notch on the memory module under test;

wherein the second notch engager has a rounded cross-sectional shape that at least partially matches a shape of the second notch on the memory module under test.

22. The reduced-insertion-force memory module socket of claim 19 further comprising:

a heat-chamber cover for covering the memory module under test when inserted into the memory module socket;

wherein the heat-chamber cover and the base board form a heat chamber that allows the memory module under test to be tested at an elevated temperature.

* * * * *